US008269707B2

(12) United States Patent
Woo et al.

(10) Patent No.: US 8,269,707 B2
(45) Date of Patent: Sep. 18, 2012

(54) LIQUID CRYSTAL DISPLAY DEVICE AND METHOD OF DRIVING THE SAME

(75) Inventors: Jae-hyuck Woo, Osan-si (KR); Jae-goo Lee, Yongin-si (KR); Won-sik Kang, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1283 days.

(21) Appl. No.: 12/014,277

(22) Filed: Jan. 15, 2008

(65) Prior Publication Data

US 2008/0180589 A1 Jul. 31, 2008

(30) Foreign Application Priority Data

Jan. 26, 2007 (KR) ..... 10-2007-0008608

(51) Int. Cl.
*G09G 3/36* (2006.01)

(52) U.S. Cl. ..... 345/96; 345/84; 349/38

(58) Field of Classification Search ..... 345/87, 345/96, 38

See application file for complete search history.

(56) References Cited

U.S. PATENT DOCUMENTS

| | | | | |
|---|---|---|---|---|
| 2004/0183768 | A1* | 9/2004 | Yamato et al. | 345/98 |
| 2005/0243045 | A1* | 11/2005 | Kim | 345/87 |
| 2006/0087484 | A1* | 4/2006 | Kumeta et al. | 345/96 |
| 2007/0103415 | A1* | 5/2007 | Ichiyama | 345/87 |

FOREIGN PATENT DOCUMENTS

| | | |
|---|---|---|
| JP | 2000-20033 | 1/2000 |
| JP | 2002-91400 | 3/2002 |
| JP | 2005-215591 | 8/2005 |
| KR | 1998-76166 | 11/1998 |
| KR | 2001-36308 | 5/2001 |

* cited by examiner

*Primary Examiner* — Alexander Eisen
*Assistant Examiner* — Robin Mishler
(74) *Attorney, Agent, or Firm* — Stanzione & Kim, LLP

(57) ABSTRACT

A liquid crystal display (LCD) that includes a plurality of pixels, a switch unit, and a gate line driving unit. Each of the pixels includes a liquid crystal capacitor having a pixel electrode and a common electrode, and the pixels are located at intersections of a plurality of gate lines and a plurality of source lines. The switch unit applies source line driving voltages having levels opposite to a common voltage applied to the common electrode, to the source lines. The gate line driving unit sequentially outputs via gate lines gate line driving voltages to control the source line driving voltages to be applied to the pixel electrodes of the pixels. The common voltage transits from a first level to a second level or vice versa at the boundary between a first half frame and a second half frame. At the first half frame, the switch unit applies the source line driving voltages to only odd-numbered source lines. At the second half frame, the switch unit applies the source line driving voltage to only even-numbered source lines.

36 Claims, 11 Drawing Sheets

LIQUID CRYSTAL DISPLAY DEVICE AND METHOD OF DRIVING THE SAME

CROSS-REFERENCE TO RELATED APPLICATIONS

This application claims priority under 35 U.S.C. §119(a) from Korean Patent Application No. 10-2007-0008608, filed on Jan. 26, 2007, in the Korean Intellectual Property Office, the disclosure of which is incorporated herein in its entirety by reference.

BACKGROUND OF THE INVENTION

1. Field of the Invention

The present general inventive concept relates to a liquid crystal display (LCD), and more particularly, to an LCD device capable of performing column inversion or dot inversion, and a method of driving the same.

2. Description of the Related Art

Liquid crystal display (LCD) devices are compact and have a small power consumption compared to other types of display devices. The LCD devices are used in electronic devices, such as notebook computers and mobile phones. In particular, an active matrix type LCD device that uses a thin film transistor as a switching device, is especially appropriate for displaying moving pictures.

FIG. 1 is a circuit diagram of an LCD panel 10 of a conventional LCD device. Referring to FIG. 1, the LCD panel 10 includes a plurality of source lines S1 through S4, a plurality of gate lines G1 through G4, a plurality of switch transistors TFT, and a plurality of liquid crystal capacitors CLC.

Each pixel includes a switch transistor TFT and a liquid crystal capacitor CLC. The switch transistor TFT is turned on or off by a signal of one of the gate lines G1 through G4. A terminal of the switch transistor TFT is connected to one of the source lines S1 through S4. The liquid crystal capacitor CLC is connected between an other terminal (pixel electrode) of the switch transistor TFT and a common electrode. A common voltage VCOM, e.g. 0 volts, is applied to the common electrode.

In order to transmit image data to each pixel of the LCD panel 10, the gate lines G1 through G4 of the LCD panel 10 are sequentially activated. The image data applied to the source lines S1 through S4 is transmitted to the pixels connected to the activated gate lines G1 through G4.

Liquid crystal fills a space between the pixel electrode and the common electrode. When a voltage is applied to the pixel electrode and the common electrode, an electric field is formed in the liquid crystal. An intensity of the electric field is adjusted to control an amount of light passing through the liquid crystal, thereby displaying an image. If an electric field is continuously applied to the liquid crystal in only one direction, the liquid crystal may be degraded. To prevent this, an inversion method is used, in which a polarity of a source voltage (data voltage) with respect to the common voltage VCOM is inverted in order to drive the liquid crystal.

FIG. 2 illustrates conventional inversion methods. FIG. 2 illustrates a frame inversion method, a line inversion method, a column inversion method, and a dot inversion method. In FIG. 2, G1 through G4 correspond to the gate lines G1 through G4 of FIG. 1, and S1 through S4 correspond to the source lines S1 through S4 of FIG. 1. A pixel is located at an intersection of one gate line and one source line. FIG. 2 illustrates 16 screen images each composed of 4×4 pixels.

In the frame inversion method, the polarity of a pixel group consisting of sixteen pixels is inverted in each frame. In the line inversion method, the polarity of a pixel group consisting of four pixels is inverted in units of lines. In the column inversion method, the polarity of a pixel group consisting of four pixels is inverted in units of columns. In the dot inversion method, the polarity of a pixel group consisting of only one pixel is inverted in units of dots.

The frame inversion method requires a small amount of power but cannot display a high-definition screen image. The dot inversion method uses more power, but is capable of displaying a high-definition image by reducing flicker, and thus has been extensively applied to large-scale LCD devices.

SUMMARY OF THE INVENTION

The present general inventive concept provides a liquid crystal display (LCD) device that can operate with low power and display high-resolution images, and a method of driving the same.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a liquid crystal display (LCD) device including a plurality of pixels each having a liquid crystal capacitor that includes a pixel electrode and a common electrode and being located at the intersections of a plurality of gate lines and a plurality of source lines, a switch unit applying source line driving voltages having levels opposite to a common voltage applied to the common electrode, to the source lines; and a gate line driving unit sequentially outputting via the gate lines gate line driving signals to control the source line driving voltages to be applied to the pixel electrodes of the pixels. The common voltage transits from a first level to a second level or vice versa at a boundary between a first half frame and a second half frame, at the first half frame, the switch unit applies the source line driving voltages to only odd-numbered source lines, and at the second half frame, the switch unit applies the source line driving voltages to only even-numbered source lines.

The LCD may further include output buffers outputting the source line driving voltages to the switch unit, wherein a total number of output buffers is equal to half a total number of the source lines. The gate line driving signals are sequentially activated at the first half frame and the second half frame.

The switch unit may include a first set of switches applying the source line driving voltages to the odd-numbered source lines in response to an activated first switch control signal, and a second set of switches applying the source line driving voltages to the even-numbered source lines in response to an activated second switch control signal. The first and second switch control signals are generated from the gate line driving signals.

At the first half frame, source line driving voltages having a positive electric potential with respect to the common voltage are applied to the odd-numbered source lines, and voltages of the even-numbered source lines are in a floating state, and at the second half frame, voltages of the odd-numbered source lines are in a floating state, and source line driving voltages having a negative electric potential with respect to the common voltage are applied to the even-numbered source lines.

At the first half frame, source line driving voltages having a negative electric potential with respect to the common voltage are applied to the odd-numbered source lines, and voltages of the even-numbered source lines are in a floating state, and at the second half frame, voltages of the odd-numbered source lines are in a floating state, and source line driving voltages having a positive electric potential with respect to the common voltage are applied to the even-numbered source lines.

The foregoing and/or other aspects and utilities of the general inventive concept may also be achieved by providing a liquid crystal display (LCD) device including a plurality of pixels each having a liquid crystal capacitor that includes a pixel electrode and a common electrode and being located at intersections of a plurality of gate lines and a plurality of source lines, a switch unit applying source line driving voltages having levels opposite to a common voltage applied to the common electrode, to the source lines, and a gate line driving unit sequentially outputting via the gate lines gate line driving signals to control the source line driving voltages to be applied to the pixel electrodes of the pixels. The common voltage transits from a first level to a second level or vice versa at a boundary between a first half frame and a second half frame, at the first half frame, the switch unit applies the source line driving voltages to odd-numbered source lines, and then to even-numbered source lines, and at the second half frame, the switch unit applies the source line driving voltages to the even-numbered source lines, and then to the odd-numbered source lines.

At the first half frame, source line driving voltages having a positive electric potential with respect to the common voltage and a floating voltage are sequentially applied to the odd-numbered source lines, where the voltages applied to the even-numbered source lines are opposite to the voltages applied to the odd-numbered source line. At a the second half frame, a floating voltage and source line driving voltages having a negative electric potential with respect to the common voltage are sequentially applied to the odd-numbered source lines, where the voltages applied to the even-numbered source lines are opposite to the voltages applied to the odd-numbered source lines.

At the first half frame, source line driving voltages having a negative electric potential with respect to the common voltage and a floating voltage are sequentially applied to the odd-numbered source lines, where the voltages applied to the even-numbered source lines are opposite to the voltages applied to the odd-numbered source line. At a the second half frame, a floating voltage and source line driving voltages having a positive electric potential with respect to the common voltage are sequentially applied to the odd-numbered source lines, where the voltages applied to the even-numbered source lines are opposite to the voltages applied to the odd-numbered source lines.

The foregoing and/or other aspects and utilities of the general inventive concept may also be achieved by providing a liquid crystal display (LCD) device including a plurality of pixels each having a liquid crystal capacitor that includes a pixel electrode and a common electrode and being located at the intersections of a plurality of gate lines and a plurality of source lines, a switch unit applying source line driving voltages having levels opposite to a common voltage applied to the common electrode, to the source lines, a gate line driving unit sequentially outputting via the gate lines gate line driving signals to control the source line driving voltages to be applied to the pixel electrodes of the pixels, and a precharge unit precharging the source lines to precharge voltages in order to prevent floating states of the source lines, before the source line driving voltages are applied to the source line. The common voltage transits from a first level to a second level or vice versa at a boundary between a first half frame and a second half frame, at the first half frame, the switch unit applies the source line driving voltages to only odd-numbered source lines, and at the second half frame, the switch unit applies the source line driving voltages to only even-numbered source lines.

Before the source line driving voltages are applied to the source lines, the precharge unit precharges the source lines to the precharge voltages in order to increase a speed of driving the voltage of each of the source lines.

The precharge unit may include precharge circuits applying the precharge voltages to the odd-numbered source lines in response to an activated first precharge control signal, and precharge circuits applying the precharge voltages to the even-numbered source lines in response to an activated second precharge control signal control signal. The first and second precharge control signals are generated from the gate line driving signals.

The foregoing and/or other aspects and utilities of the general inventive concept may also be achieved by a liquid crystal display (LCD) device including a plurality of pixels each having a liquid crystal capacitor that includes a pixel electrode and a common electrode and being located at intersections of a plurality of gate lines and a plurality of source lines, a switch unit applying source line driving voltages having levels opposite to a common voltage applied to the common electrode, to the source lines, a precharge unit precharging the source lines to precharge voltages in order to prevent floating states of the source lines, before the source line driving voltages are applied to the source line, and a gate line driving unit sequentially outputting via the gate lines gate line driving signals to control the source line driving voltages to be applied to the pixel electrodes of the pixels. The common voltage transits from a first level to a second level or vice versa at a boundary between a first half frame and a second half frame, at the first half frame, the switch unit applies the source line driving voltages to odd-numbered source lines of the source lines and then to even-numbered source lines, and at the second half frame, the switch unit applies the source line driving voltages to the even-numbered source lines, and then to the odd-numbered source lines.

The foregoing and/or other aspects and utilities of the general inventive concept may also be achieved by a method of driving a liquid crystal display (LCD) device having a plurality of pixels each including a liquid crystal capacitor that includes a pixel electrode and a common electrode and being located at intersections of a plurality of gate lines and a plurality of source lines, the method including allowing a common voltage, which is applied to the common electrode, to transit from a first level to a second level or vice versa at a boundary between a first half frame and a second half frame, at the first half frame, applying source line driving voltages having levels opposite to the common voltage to only odd-numbered source lines, at the second half frame, applying the source line driving voltages to only even-numbered source lines, and sequentially activating gate line driving signals at the first and second half frames, where the gate line driving signals control the source line driving voltages applied to the source lines to be applied to the pixel electrodes of the pixels.

The method may further includes precharging the source lines to precharge voltages so as to prevent floating states of the source lines, before applying the source line driving voltages to the source lines.

The method may further include precharging the source lines to precharge voltages so as to increase a speed of driving one of voltages of the source lines, before applying the source line driving voltages to the source lines.

The foregoing and/or other aspects and utilities of the general inventive concept may also be achieved by a method of driving a liquid crystal display (LCD) device having a plurality of pixels each including a liquid crystal capacitor that includes a pixel electrode and a common electrode and being located at the intersections of a plurality of gate lines and a plurality of source lines, the method including allowing a common voltage, which is applied to the common electrode, to transit from a first level to a second level or vice versa at a boundary between a first half frame and a second half frame, at the first half frame, applying source line driving voltages having levels opposite to the common voltage to odd-numbered source lines and then to even-numbered source lines, at the second half frame, applying the source line driving voltages to the even-numbered source lines and then to the odd-numbered source lines, and sequentially activating gate line driving signals at the first and second half frames, where the gate line driving signals control the source line driving voltages to be applied to the pixel electrodes of the pixels.

An LCD (liquid crystal display) device including a plurality of gate lines, a plurality of source lines and a plurality of pixels disposed at an intersection of the gate lines and source lines, respectively, and a switch unit to apply source line driving voltages to one of odd-numbered source lines and even numbered source lines at a first portion of a frame, and to apply the source line driving voltages to an other of the odd-numbered source lines and the even numbered source lines at a second portion of the frame.

Each of the pixels may include a liquid crystal capacitor having a pixel electrode and a common electrode, wherein a common voltage is applied to the respective common electrodes.

The LCD may further include a precharge unit to precharge the source lines to precharge voltages prior to the source line driving voltages being applied to the source lines to prevent floating states of the source lines.

A computer-readable recording medium having embodied thereon a computer program to execute a method, wherein the method includes allowing a common voltage applied to the common electrode to transit between a first level and a second level at a boundary between a first half frame and a second half frame, applying source line driving voltages having levels opposite to the common voltage to odd-numbered source lines at the first half frame, applying the source line driving voltages to even-numbered source lines at the second half frame, and sequentially activating gate line driving signals at the first and second half frames, wherein the gate line driving signals control the source line driving voltages applied to the source lines to be applied to pixel electrodes of the pixels.

BRIEF DESCRIPTION OF THE DRAWINGS

The above and other aspects and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
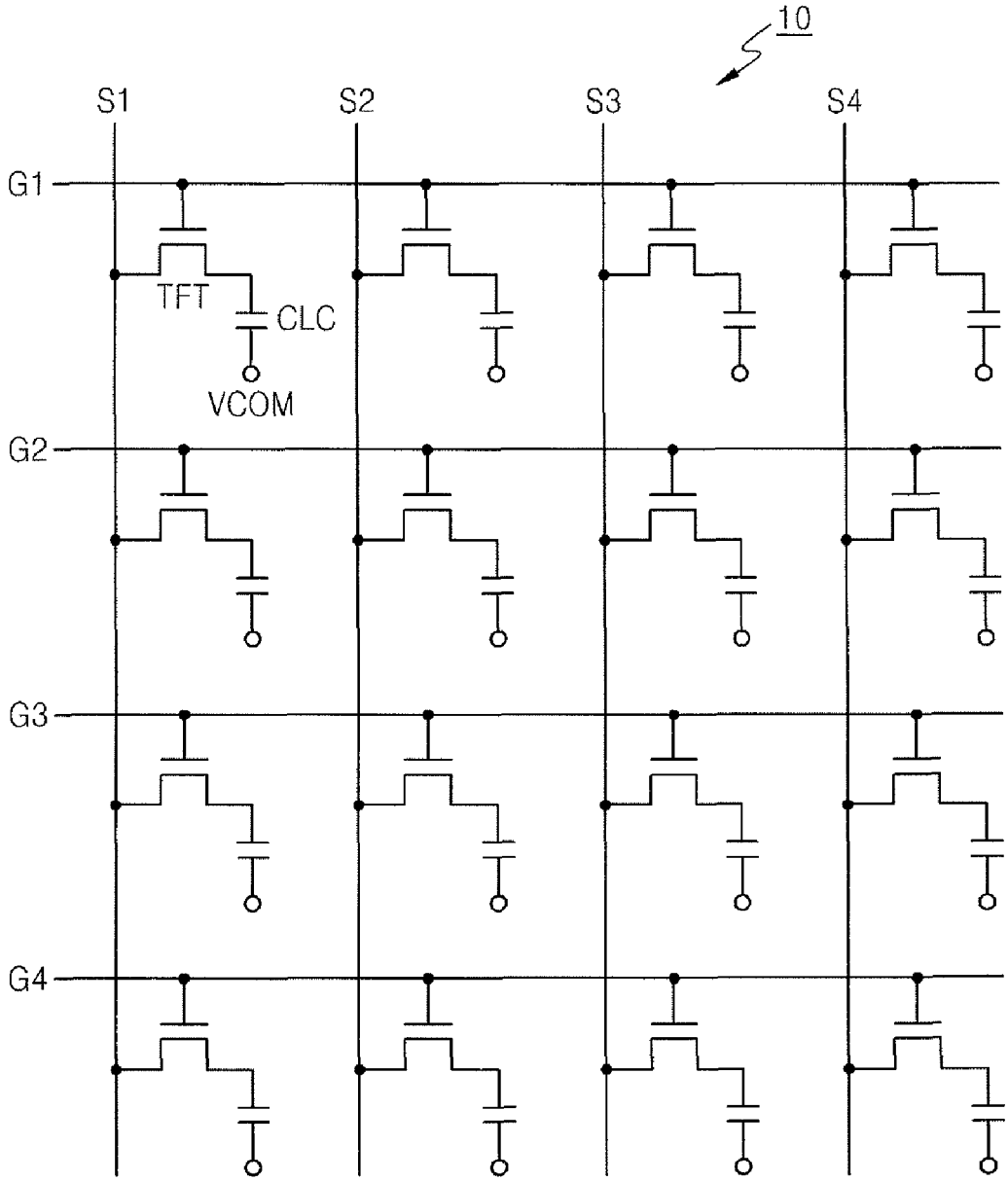
FIG. 1 (CONVENTIONAL ART)
FIG. 1 is a circuit diagram illustrating a liquid crystal display (LCD) panel of a conventional LCD device.
Figure 2:
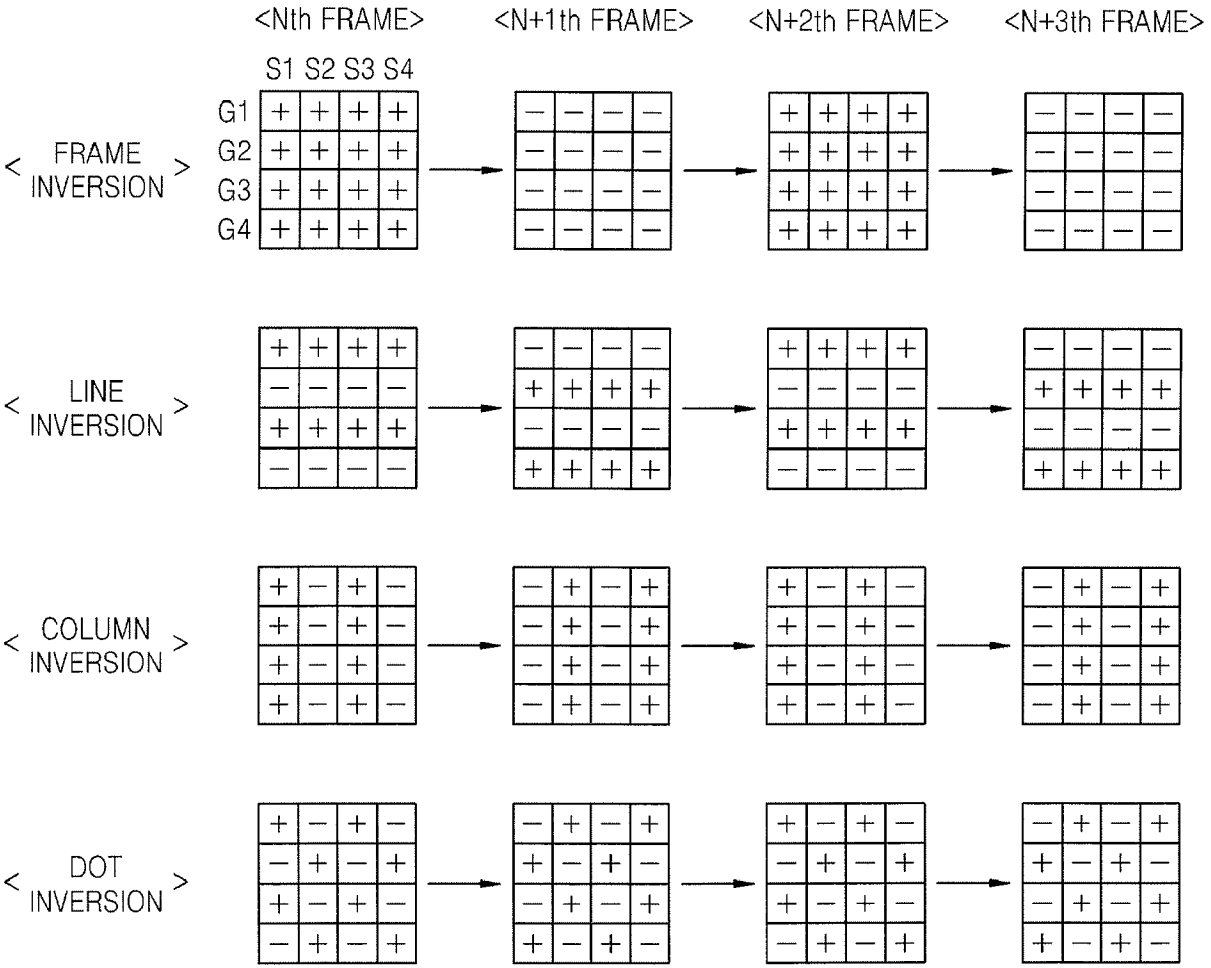
FIG. 2 (CONVENTIONAL ART)
FIG. 2 illustrates conventional inversion methods.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
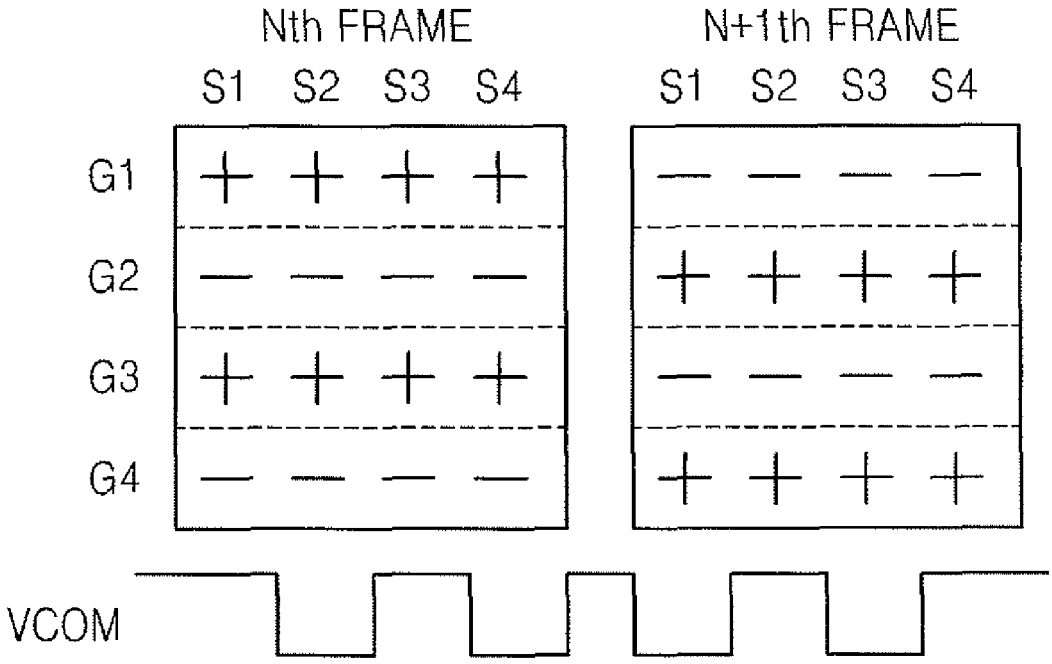
FIG. 3 illustrates gate lines driven using a line inversion method according to a comparative example of the present general inventive concept.

A comparative example of an embodiment of the present general inventive concept will be described with reference to FIG. 3. FIG. 3 illustrates gate lines driven using a line inversion method. The line inversion method may be applied to the LCD panel 10 illustrated in FIG. 1.

Referring to FIG. 3, whenever gate lines G1 through G4 of an $N^{th}$ frame are scanned, a polarity of a common voltage VCOM is inverted. For example, when positive polarity data with respect to the common voltage VCOM applied to source lines S1 through S4 is transmitted to odd-numbered gate lines G1 and G3, negative polarity data with respect to the common voltage VCOM applied to the source lines S1 through S4 is transmitted to even-numbered gate lines G2 and G4. When an $N+1^{th}$ frame is scanned, the polarities of the odd-numbered gate lines G1 and G3 and the even-numbered gate lines G2 and G4 are inverted, thus preventing degradation of the liquid crystal.

However, since the polarity of the common voltage VCOM is inverted whenever the gate lines G1 through G4 are scanned, the line inversion method may consume a great amount of power. Middle or small-sized LCDs, such as mobile phone displays, may include a QVGA (Quarter Video Graphics Array) LCD panel. The resolution of QVGA is 240×320 pixels. The QVGA-class LCD has 320 gate lines, and thus the polarity of the common voltage VCOM may be changed 320 times for each frame. Thus, when an LCD employing the line inversion method is used in a middle or small-sized LCD, such as a mobile phone display, the LCD may consume a large amount of power. Accordingly, there is a need for an LCD that is capable of displaying high-definition images with less power and may be applied to mobile phones.

Figure 4:
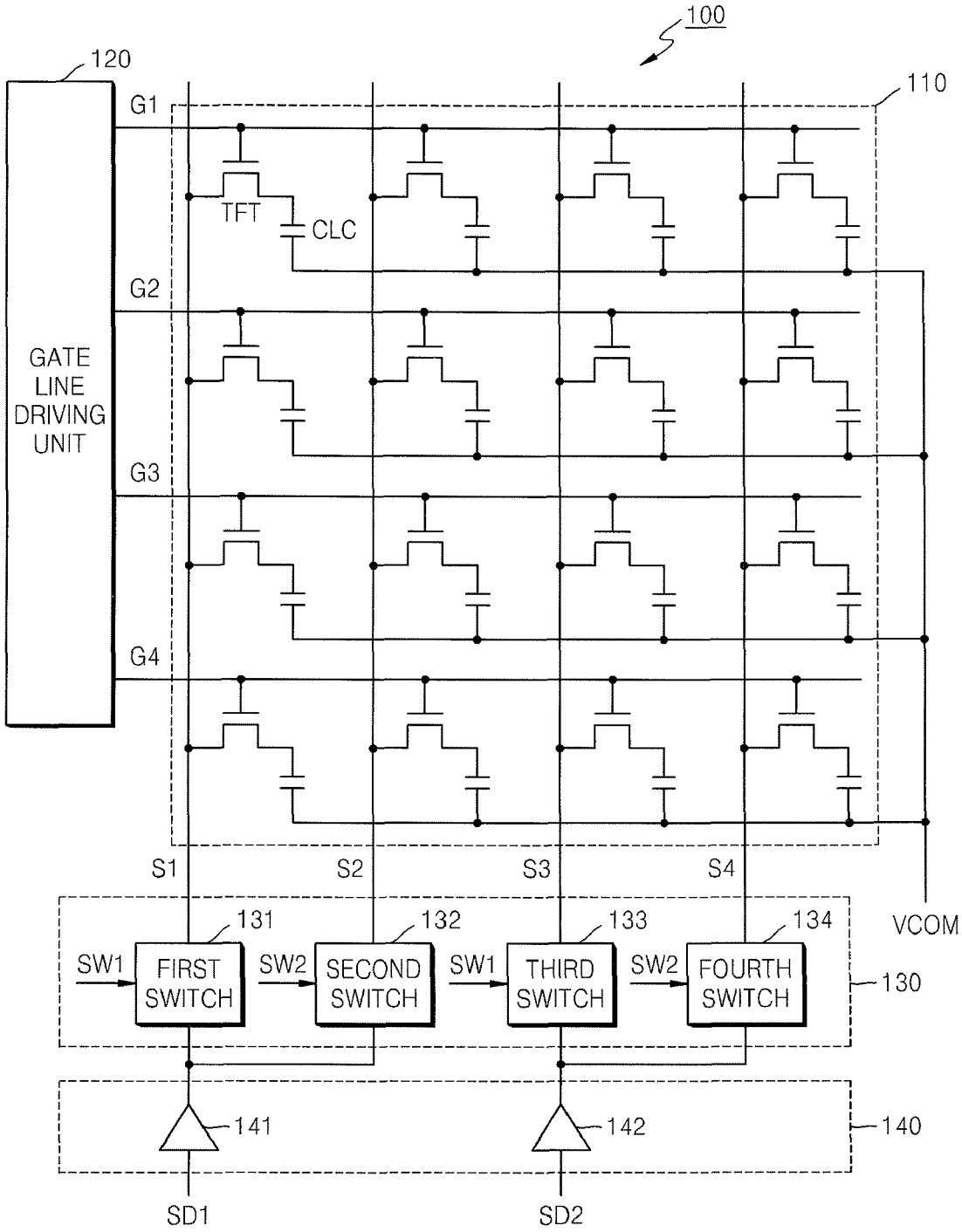
FIG. 4 is a block diagram illustrating an LCD device 100 according to an embodiment of the present general inventive concept.

FIG. 4 is a block diagram illustrating an LCD device 100 according to an embodiment of the present general inventive concept. Referring to FIG. 4, the LCD device 100 includes an LCD panel 110, a gate line driving unit 120, a switch unit 130, and a source line driving unit (source driver) 140. The LCD device 100 performs a column inversion operation or a dot inversion operation.

The LCD panel 110 includes a plurality of source lines S1 through S4, a plurality of gate lines G1 through G4, a plurality of switch transistors TFT, and a plurality of liquid crystal capacitors CLC. In this example, the LCD panel 110 includes 4×4 pixels.

One pixel is located at an intersection of one gate line and one source line, and includes a switch transistor TFT and a liquid crystal capacitor CLC. Each of the switch transistors TFT is turned on or off when the signal of one of the gate lines G1 through G4 is applied to a gate terminal of each switch transistor TFT. One terminal of each of the switch transistors TFT is connected to one of the source lines S1 through S4. Each of the liquid crystal capacitors CLCs is connected between an other terminal (pixel electrode) of one of the switch transistors TFT and a common electrode. A common voltage VCOM is applied to the common electrode.

The switch unit 130 applies source line driving voltages SD1 and SD2, which are of opposite polarity (level) to the common voltage VCOM, to the source lines S1 through S4. The common voltage VCOM is applied to the common electrode of the liquid crystal capacitor CLC.

The switch unit 130 includes a plurality of switches, for example, first, second, third, and fourth switches. The first switch 131 and the third switch 133 are turned on in response to an activated first switch control signal SW1, so as to apply the source line driving voltages SD1 and SD2 to the odd-numbered source lines S1 and S3. The second switch 132 and the fourth switch 134 are turned on in response to an activated second switch control signal SW2, so as to apply the source line driving voltages SD1 and SD2 to the even-numbered source lines S2 and S4. For example, the first and second switch control signals SW1 and SW2 may be generated from gate line driving signals, to drive the gate lines G1 through G4, which are received from the gate line driving unit 120. That is, the first and second switch control signals SW1 and SW2 may be generated from the gate line driving unit 120 according to the gate line driving signals. The first and second switch control signals SW1 and SW2 may be generated by a timing controller included in the LCD device 100.

The source line driving unit 140 includes a plurality of output buffers (source amplifiers) 141 and 142. The total number of output buffers in the source line driving unit 140 is equal to half the total number of source lines S1 through S4. The output buffers 141 and 142 apply the source line driving voltages SD1 and SD2 to the switch unit 130.

The gate line driving unit 120 sequentially outputs via the gate lines G1 through G4 the gate line driving signals to control the source line driving voltages SD1 and SD2 to be applied to the pixel electrodes of the pixels.

Figure 5:
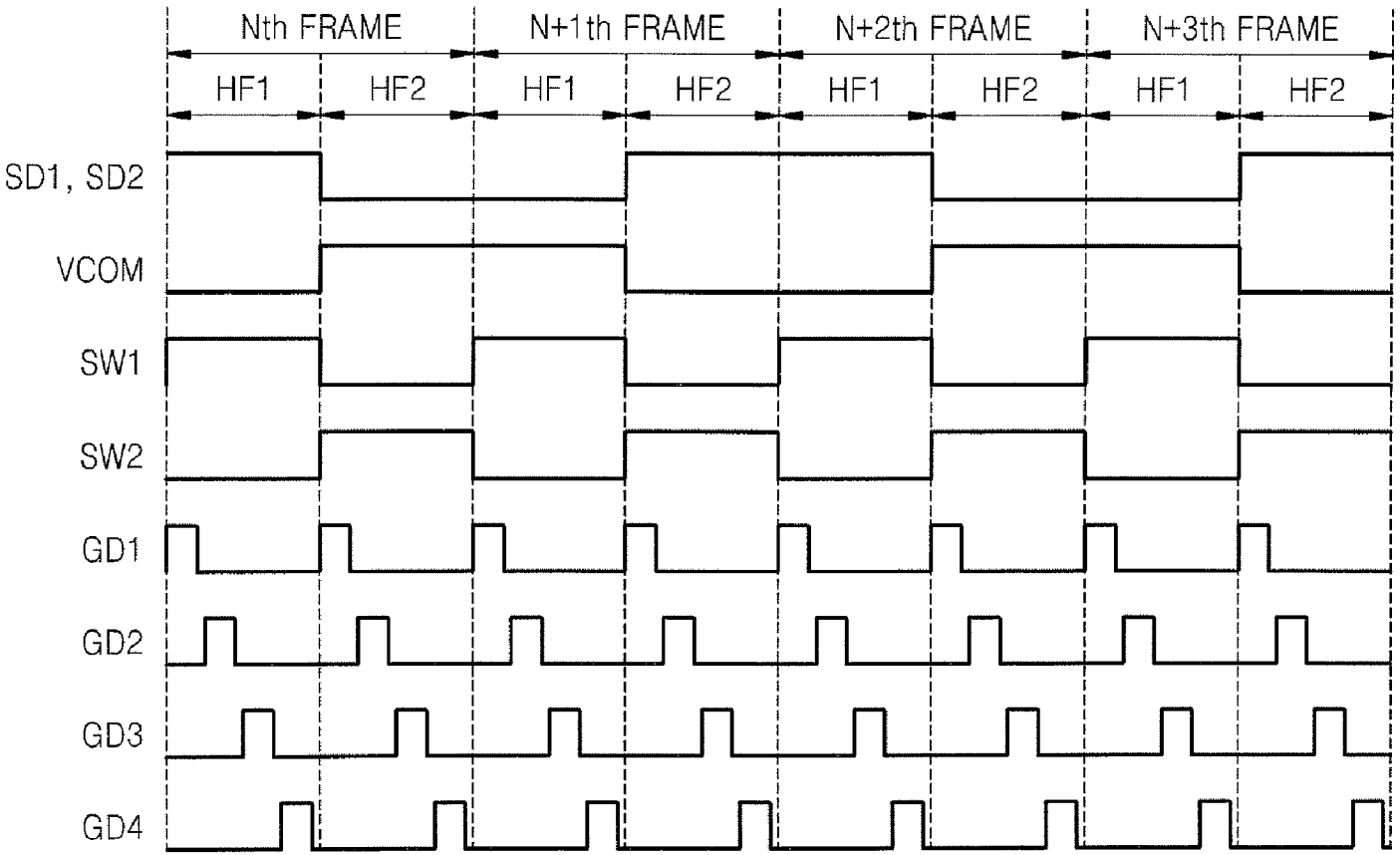
FIG. 5 is a timing diagram illustrating a column inversion operation performed by the LCD device of FIG. 4, according to an embodiment of the present general inventive concept.

FIG. 5 is a timing diagram illustrating the column inversion method performed by the LCD device 100 of FIG. 4. The column inversion method performed by the LCD device 100 will now be described with reference to FIGS. 4 and 5.

The common voltage VCOM transits from a first level, for example, high, to a second level, for example, low, or vice versa at the boundary between a first half frame HF1 and a second half frame HF2 of each of an $N^{th}$ frame, an $N+1^{th}$ frame, an $N+2^{th}$ frame, and an $N+3^{th}$ frame. For example, the high level of the common voltage VCOM may be 5 volts and the low level may be 0 volts. Here, the frame can represent a period in which an image can be displayed by all pixels of the LCD.

The levels of the source line driving voltages SD1 and SD2 are opposite to that of the common voltage VCOM. That is, the source line driving voltages SD1 and SD2 are 180 degrees out of phase with the common voltage VCOM. The source line driving voltages SD1 and SD2 include a positive polarity voltage and a negative polarity voltage with respect to the common voltage VCOM.

At the first half frame HF1, the first switch control signal SW1 to control the first and third switches 131 and 133 is activated to the high level, and thus the switch unit 130 that includes the first and third switches 131 and 133 applies the source line driving voltages SD1 and SD2 to only the odd-numbered source lines S1 and S3.

At the second half frame HF2, the second switch control signal SW2 to control the second and fourth switches 132 and 134 is activated to a high level, and thus the switch unit 130 that includes the second and fourth switches 132 and 134 applies the source line driving voltages SD1 and SD2 to only the even-numbered source lines S2 and S4.

The gate line driving signals GD1 through GD4 to control the source line driving voltages SD1 and SD2 are sequentially activated at the first and second half frames HF1 and HF2. That is, the gate line driving signals GD1 through GD4 are sequentially activated twice for each frame. The switch transistors TFT of the pixels are turned on so as to apply the source line driving voltages SD1 and SD2 to the pixel electrodes of the liquid crystal capacitor CLCs, in response to the activated gate line driving signals GD1 through GD4.

Figure 6:
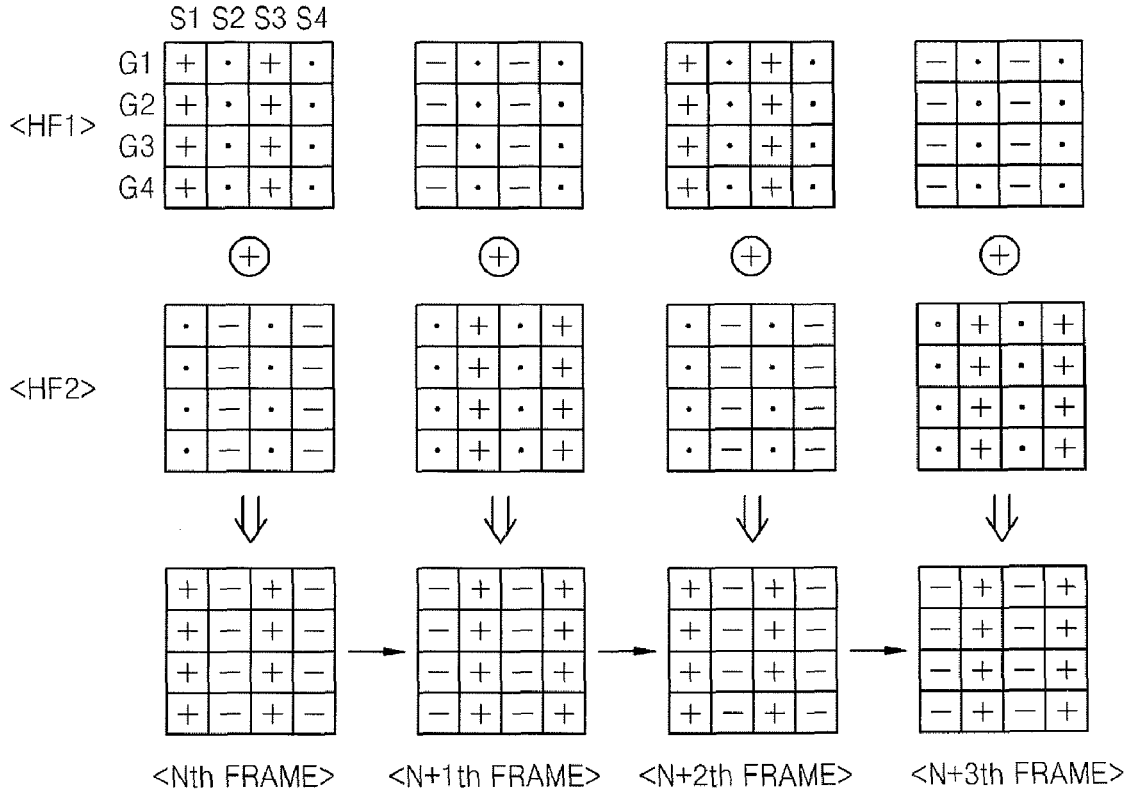
FIG. 6 illustrates screen constructions according to the column inversion method of FIG. 5, according to an embodiment of the present general inventive concept.

FIG. 6 illustrates screen constructions according to the column inversion method described above with reference to FIG. 5. Referring to FIG. 6, at a first half frame HF1 of an $N^{th}$ frame, a source line driving voltage (positive polarity voltage) having a positive electric potential with respect to the common voltage VCOM is applied to the odd-numbered source lines S1 and S3, and the even-numbered source lines S2 and S4 are in a floating state marked by ".".

At a second half frame HF2 of the $N^{th}$ frame, the odd-numbered source lines S1 and S3 are in a floating state, and a source line driving voltage (negative polarity voltage) having a negative electric potential with respect to the common voltage VCOM is applied to the even-numbered source lines S2 and S4.

Thus, when the first and second half frames HF1 and HF2 of the $N^{th}$ frame are combined, the positive polarity voltage is applied to the odd-numbered source lines S1 and S3 of the $N^{th}$ frame and the negative polarity voltage is applied to the even-numbered source lines S2 and S4 of the $N^{th}$ frame.

The screen constructions of an $N+1^{th}$ frame, an $N+2^{th}$ frame, and an $N+3^{th}$ frame are similar to the above screen construction of the $N^{th}$ frame. In conclusion, as illustrated in FIG. 6, the column inversion method is performed from the $N^{th}$ frame to the $N+3^{th}$ frame.

Figure 7:
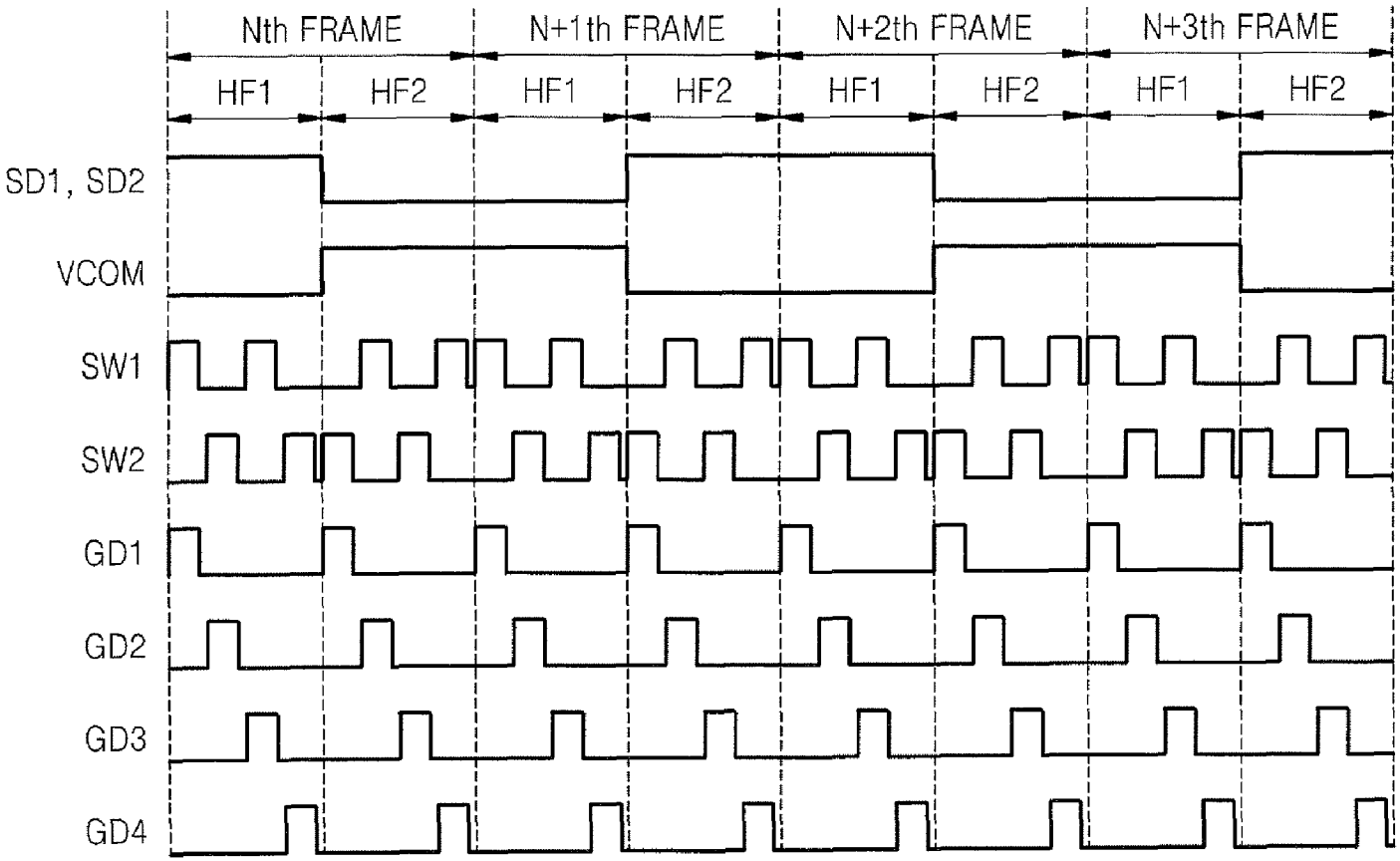
FIG. 7 is a timing diagram illustrating a dot inversion operation performed by the LCD device of FIG. 4, according to an embodiment of the present general inventive concept.

FIG. 7 is a timing diagram illustrating the dot inversion method performed by the LCD device 100, according to an embodiment of the present general inventive concept. The dot inversion method of the LCD device 100 will be described with reference to FIGS. 4 and 7.

The common voltage VCOM transits from a first level (high) to a second level (low) or vice versa at the boundary between a first half frame HF1 and a second half frame HF2 of each of an $N^{th}$ frame, an $N+1^{th}$ frame, an $N+2^{th}$ frame, and an $N+3^{th}$ frame. For example, the high level of the common voltage VCOM may be 5 volts, and the low level may be 0 volts.

The levels of the source line driving voltages SD1 and SD2 are opposite to that of the common voltage VCOM. That is, the source line driving voltages SD1 and SD2 are 180 degrees out of phase with the common voltage VCOM. The source line driving voltages SD1 and SD2 include a positive polarity voltage and a negative polarity voltage with respect to the common voltage VCOM.

At the first half frame HF1, a first switch control signal SW1 to control the first and third switches 131 and 133 is activated to a high level, and then a second switch control signal SW2 to control the second and fourth switches 132 and 134 is activated to the high level. Accordingly, the switch unit 130 that includes the first through fourth switches 131 through 134 applies the source line driving voltages SD1 and SD2 to the odd-numbered source lines S1 and S3, and then to the even-numbered source lines S2 and S4.

At a second half frame HF2, the second switch control signal SW2 to control the second and fourth switches 132 and 134 is activated to the high level, and then the first switch control signal SW1 to control the first and third switches 131 and 133 is activated to the high level. Thus, the switch unit 130 that includes the first through fourth switches 131 through 134 applies the source line driving voltages SD1 and SD2 to the even-numbered source lines S2 and S4 and then to the odd-numbered source lines S1 and S3.

The gate line driving signals GD1 through GD4 to control the source line driving voltages SD1 and SD2 are sequentially activated at the first half frame HF1 and the second half frame HF2. That is, the gate line driving signals GD1 through GD4 are sequentially activated twice for each frame. The switch transistors TFT of the pixels are turned on in response to the activated gate line driving signals GD1 through GD4, thus applying the source line driving voltages SD1 and SD2 to the pixel electrodes of the liquid crystal capacitor CLCs.

Figure 8:
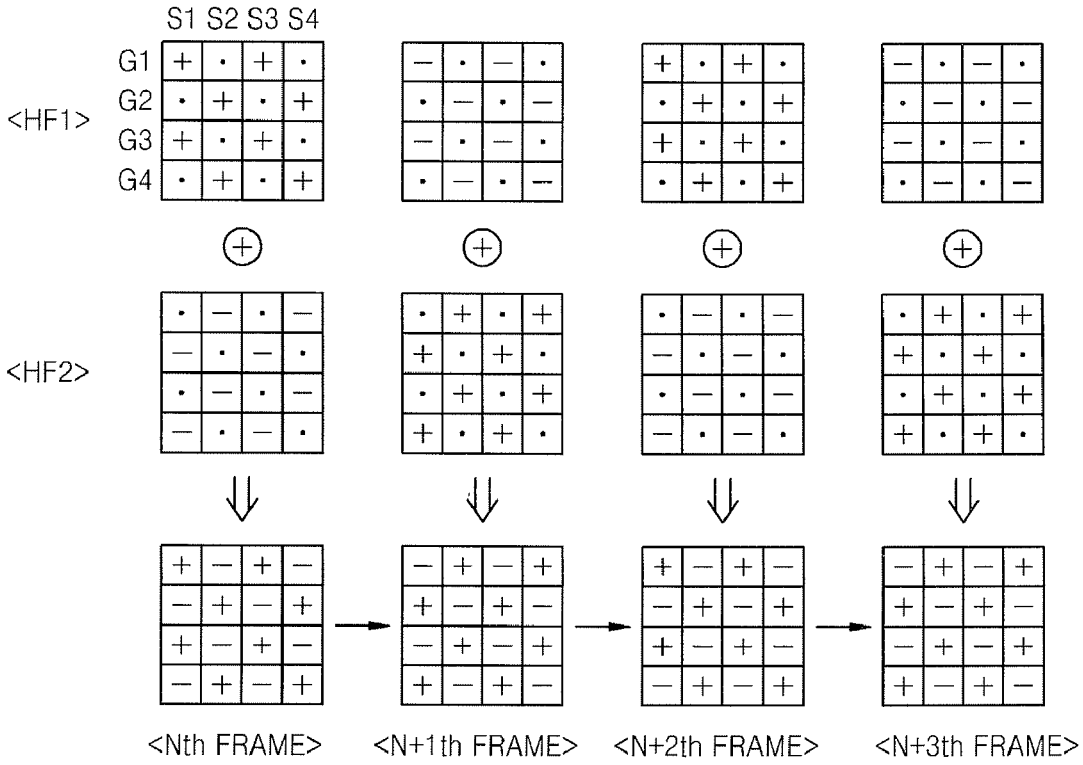
FIG. 8 illustrates screen constructions according to the dot inversion method of FIG. 7, according to an embodiment of the present general inventive concept.

FIG. 8 illustrates screen constructions according to the inversion method described above with reference to FIG. 7, according to an embodiment of the present general inventive concept. Referring to FIG. 8, at a first half frame HF1 of an $N^{th}$ frame, a source line driving voltage (the positive polarity voltage) having a positive electric potential with respect to the common voltage VCOM, and a floating voltage represented by a "." are sequentially applied to the odd-numbered source lines S1 and S3. The voltages applied to the even-numbered source lines S2 and S4 are opposite to the voltages applied to the odd-numbered source lines S1 and S3.

At a second half frame HF2 of the $N^{th}$ frame, the floating voltage, and a source line driving voltage (negative polarity voltage) having a negative electric potential with respect to the common voltage VCOM are sequentially applied to the odd-numbered source lines S1 and S3. The voltages applied to the even-numbered source lines S2 and S4 are opposite to the voltages applied to the odd-numbered source lines S1 and S3.

Accordingly, when the first half frame HF1 and the second half frame HF2 of the $N^{th}$ frame are combined, a positive polarity voltage and a negative polarity voltage are sequentially applied to the odd-numbered source lines S1 and S3 of the $N^{th}$ frame, and a negative polarity voltage and a positive polarity voltage are sequentially applied to the even-numbered source lines S2 and S4.

The screen constructions of an $N+1^{th}$ frame, an $N+2^{th}$ frame, and an $N+3^{th}$ frame are similar to the above screen construction of the $N^{th}$ frame. In conclusion, as illustrated in FIG. 8, the dot inversion method is performed from the $N^{th}$ frame to the $N+3^{th}$ frame.

Therefore, the LCD device 100 (FIG. 4) according to an embodiment of the present general inventive concept is capable of significantly reducing power consumption, since a level of the common voltage VCOM transits only once for each frame, as compared to an LCD device employing the line inversion method described above with reference to FIG. 3. The LCD device 100 is also capable of reducing a frequency of the common voltage VCOM to be equal to a frequency of frame, thereby minimizing audible noise that may occur in an LCD device employing the line inversion method described above with reference to FIG. 3. Also, an LCD device employing the line inversion method described above with reference to FIG. 3 drives a source line by using one output buffer, but the LCD device 100 (FIG. 4) is capable of driving two adjacent source lines by using one output buffer. Accordingly, a chip size of a source line driving unit can be effectively reduced.

Figure 11:
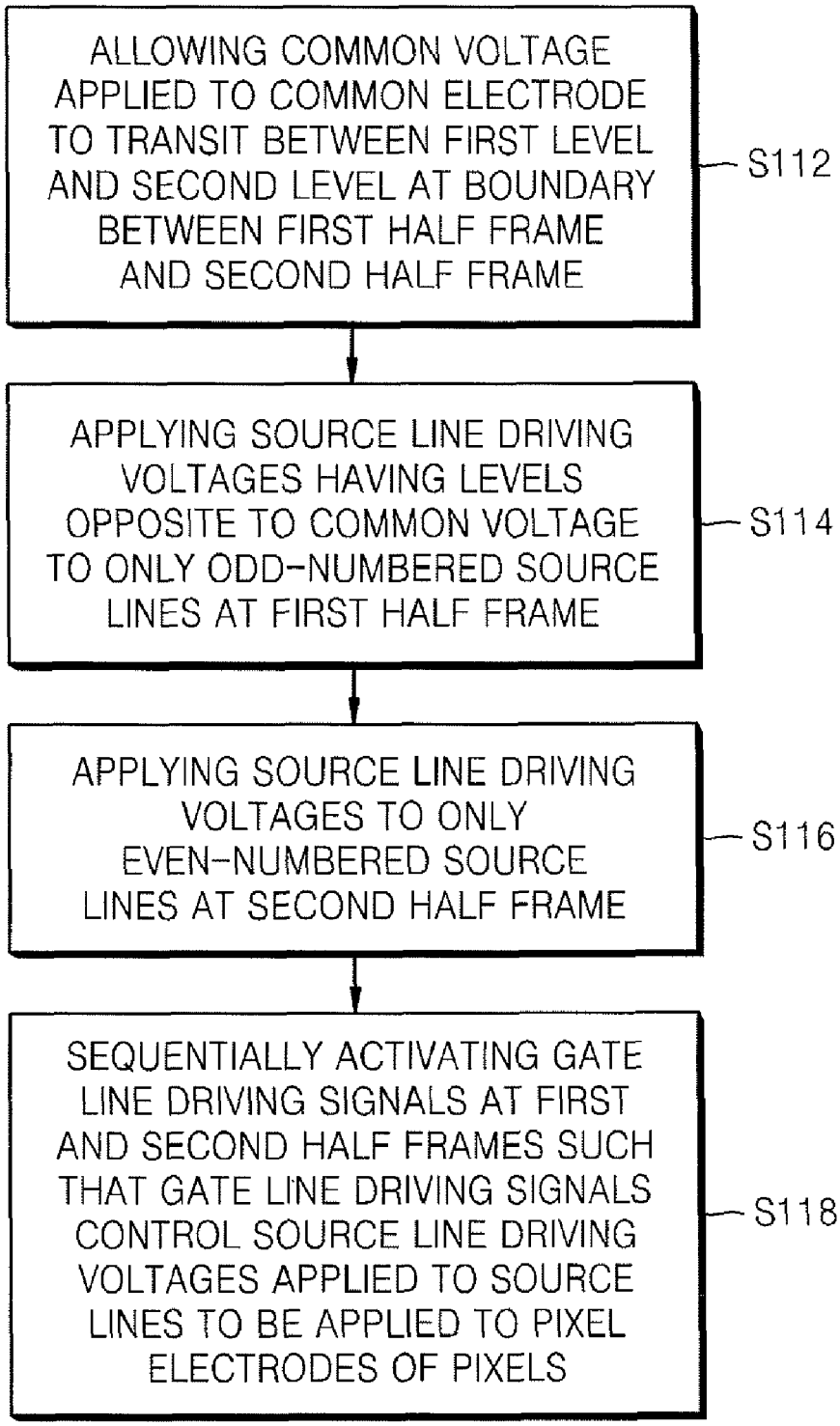
FIG. 11 is a flowchart illustrating a method of driving an LCD device according to an embodiment of the present general inventive concept.

FIG. 11 is a flowchart illustrating a method of driving an LCD device according to an embodiment of the present general inventive concept. Referring to FIG. 4, the LCD device 100, for example, may include a plurality of pixels each including a liquid crystal capacitor CLC having a pixel electrode and a common electrode, and being located at intersections of a plurality of gate lines G1 through G4 and a plurality of source lines S1 through S4. Referring to FIGS. 4, 5 and 11, in operation S112, a common voltage VCOM applied to the respective common electrode is allowed to transit between a first level and a second level at a boundary between a first half frame HF1 and a second half frame HF2. In operation S114, source line driving voltages SD1 and SD2 having levels opposite to the common voltage VCOM are applied to only odd-numbered source lines S1 and S3 at the first half frame HF1. In operation S116, the source line driving voltages SD1 and SD2 are applied to only even-numbered source lines at the second half frame HF2. In S118, gate line driving signals GD1 through GD4 are sequentially activated at the first half frame HF1 and the second half frame HF2 such that the gate line driving signals GD1 to GD4 control the source line driving voltages SD1 and SD2 applied to the source lines S1 through S4 to be applied to the pixel electrodes of the pixels.

Figure 9:
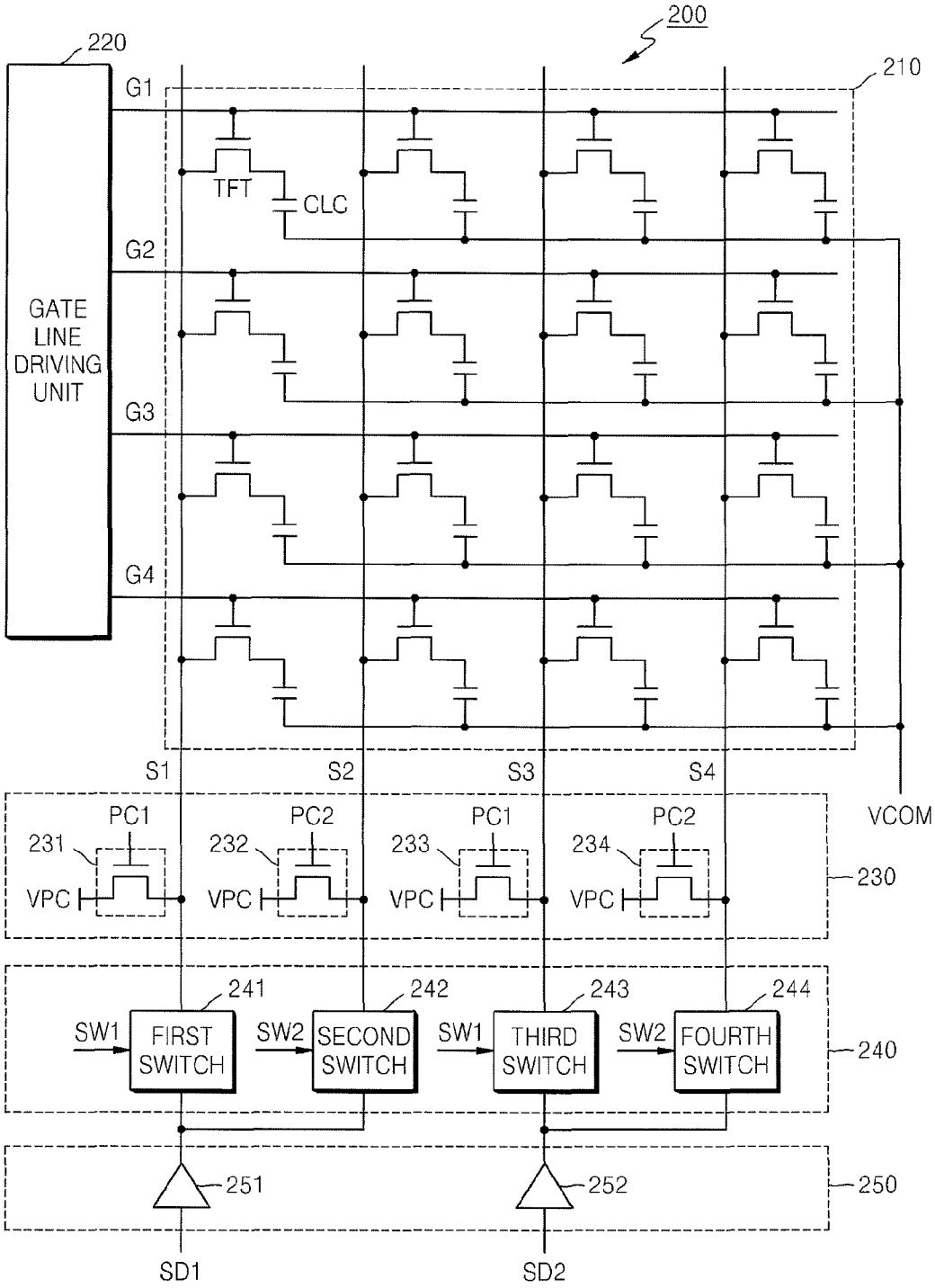
FIG. 9 is a block diagram illustrating an LCD device according to another embodiment of the present general inventive concept.

FIG. 9 is a block diagram of an LCD device 200 according to another embodiment of the present general inventive concept. Referring to FIG. 9, the LCD device 200 includes an LCD panel 210, a gate line driving unit 220, a switch unit 240, a precharge unit 230, and a source line driving unit 250.

The LCD panel 210 includes a plurality of source lines S1 through S4, a plurality of gate lines G1 through G4, a plurality of switch transistors TFT, and a plurality of liquid crystal capacitors CLC. In this example, the LCD panel 210 includes 4×4 pixels.

One pixel is located at the intersection of one gate line and one source line, and includes a switch transistor TFT and a liquid crystal capacitor CLC. The switch transistor TFT is turned on or off by a signal of one of the gate lines G1 through G4. One terminal of each of the switch transistors TFT is connected to one of the source lines S1 through S4. The liquid crystal capacitor CLC is connected between the other terminal (pixel electrode) of the switch transistor TFT and a common electrode. A common voltage VCOM is applied to the common electrode.

The precharge unit 230 precharges the source lines S1 through S4 to a precharge voltage VPC in order to prevent them floating, before source line driving voltages SD1 and SD2 are applied to the source lines S1 through S4. Thus, the precharge unit 230 prevents image degradation caused by the source lines S1 through S4 floating. For example, the precharge voltage VPC may be half a maximum voltage applied to the source lines S1 through S4. The precharge voltage VPC may be applied from outside of the LCD device 200.

Also, the precharge unit 230 precharges the source lines S1 through S4 to the precharge voltage VPC in order to increase a speed of driving the voltages of the source lines S1 through S4, before the source line driving voltages SD1 and SD2 are applied to the source lines S1 through S4. Thus, the precharge unit 230 is capable of reducing power consumption when driving the source lines S1 through S4.

The precharge unit 230 includes a plurality of precharge circuits 231 through 234. The precharge circuits 231 through 234 may be NMOS transistors. The first precharge circuit 231 and the third precharge circuit 233 are turned on in response to an activated first precharge control signal PC1, thus applying the precharge voltage VPC to the odd-numbered source lines S1 and S3. The second precharge circuit 232 and the fourth precharge circuit 234 are turned on in response to an activated second precharge control signal PC2, thus applying the precharge voltage VPC to the even-numbered source lines S2 and S4. For example, the first and second precharge control signals PC1 and PC2 may be generated from gate line driving signals, output from the gate line driving unit 220, to drive the gate lines G1 through G4. The first and second precharge control signals PC1 and PC2 may be generated by a timing controller included in the LCD device 200.

The switch unit 240 applies the source line driving voltages SD1 and SD2, which have opposite polarity to the common voltage VCOM, to the source lines S1 through S4. The common voltage VCOM is applied to the common electrode of the liquid crystal capacitor CLC.

The switch unit 240 includes a plurality of switches 241 through 244. The first switch 241 and the third switch 243 are turned on in response to an activated first switch control signal SW1, thus applying the source line driving voltages SD1 and SD2 to the odd-numbered source lines S1 and S3. The second switch 242 and the fourth switch 244 are turned on in response to an activated second switch control signal SW2, thus applying the source line driving voltages SD1 and SD2 to the even-numbered source lines S2 and S4. For example, the first and second switch control signals SW1 and SW2 may be generated using the gate line driving signals. The first and second switch control signals SW1 and SW2 may be generated by the timing controller in the LCD device 200.

The source line driving unit 250 includes a plurality of output buffers 251 and 252. A total number of output buffers of the source line driving unit 250 is equal to half the total number of source lines S1 through S4. The output buffers 251 and 252 output the source line driving voltages SD1 and SD2 to the switch unit 240.

The gate line driving unit 220 sequentially outputs via gate lines G1 through G4 gate line driving signals to control the source line driving voltages SD1 and SD2 to be applied to pixel electrodes of the pixels.

The LCD device 200 performs an operation similar to the column inversion operation, illustrated in FIG. 5, which is performed by the LCD device 100 (FIG. 4), or an operation similar to the dot inversion operation, illustrated in FIG. 7, which is performed by the LCD device 100 (FIG. 4). Also, the operation of the LCD device 200 includes that of the precharge unit 230, and therefore, the operation of the precharge unit 230 will be described with reference to FIG. 10.

Figure 10:
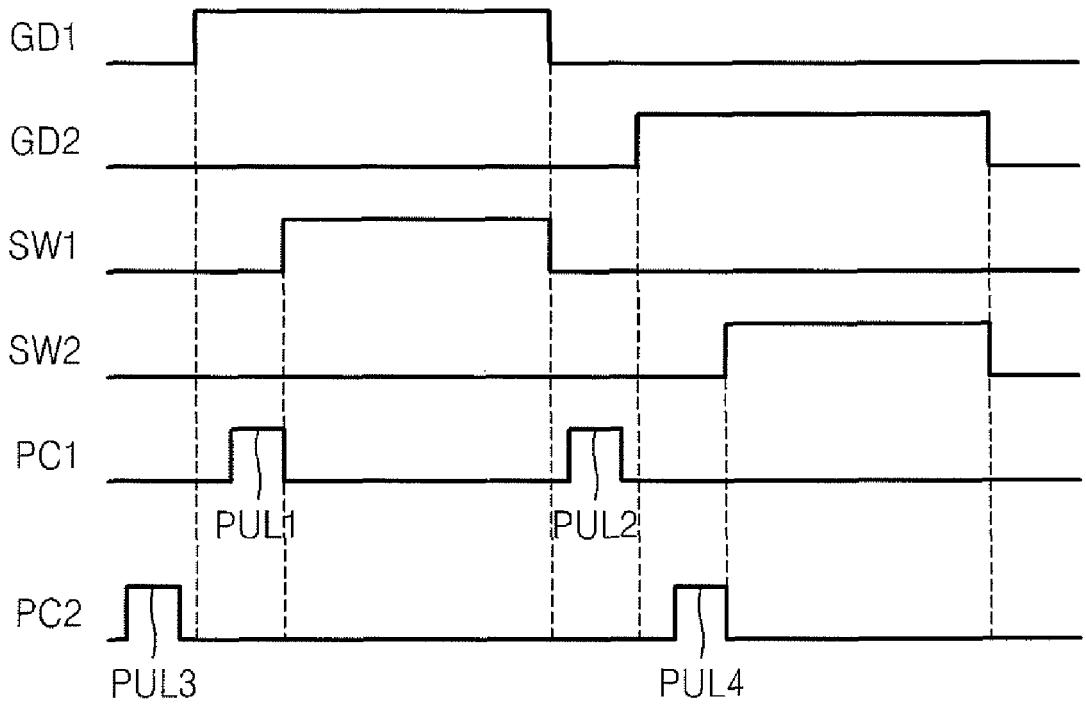
FIG. 10 is a timing diagram illustrating the operation of a precharge unit of FIG. 9, according to an embodiment of the present general inventive concept.

FIG. 10 is a timing diagram illustrating an operation of the precharge unit 230 of FIG. 9. Referring to FIGS. 9 and 10, a first switch control signal SW1 is activated to a high level while a first gate line driving signal GD1 to drive the first gate line G1 is activated to a high level. The first switch control signal SW1 controls the first and third switches 241 and 243 that apply source line driving voltages SD1 and SD2 to the odd-numbered source lines S1 and S3.

Before the first switch control signal SW1 is activated to the high level, a first precharge control signal PC1 to control the first and third precharge circuits 231 and 233 is activated to a high level with a first pulse PUL1. Then, before the source line driving voltages SD1 and SD2 are applied to the odd-numbered source lines S1 and S3, precharge voltages VPC each increasing the speed of driving a voltage applied to one of the odd-numbered source lines S1 and S3 are applied to the odd-numbered source line S1 and S3.

After the first switch control signal SW1 is deactivated from the high level to a low level (after both the first switch control signal SW1 and the first gate line driving signal GD1 are deactivated to the low level), the first precharge control signal PC1 is activated to a high level with a second pulse PUL2. Then, after applying the source line driving voltages SD1 and SD2 to the odd-numbered source lines S1 and S3, the precharge voltages VPC are applied to the odd-numbered source lines S1 and S3 in order to prevent the odd-numbered source lines S1 and S3 from floating.

While a second gate line driving signal GD2 to drive the second gate line G2 is activated to the high level, a second switch control signal SW2 to control the second and fourth switches 242 and 244 that apply the source line driving voltages SD1 and SD2 to the even-numbered source lines S2 and S4, is activated to the high level.

Before the second switch control signal SW2 is activated to the high level, a second precharge control signal PC2 to control the second and fourth precharge circuits 232 and 234 is activated to a high level with a fourth pulse PUL4. Then, before the source line driving voltages SD1 and SD2 are applied to the even-numbered source lines S2 and S4, precharge voltages VPC to increase the speed of driving voltages applied to the even-numbered source lines S2 and S4 are applied to the even-numbered source lines S2 and S4.

While both the second switch control signal SW2 and the second gate line driving signal GD2 are deactivated to a low level, the second precharge control signal PC2 is activated to a high level with a third pulse PUL3. Then, after applying the source line driving voltages SD1 and SD2 to the even-numbered source lines S2 and S4, the precharge voltages VPC are applied to the even-numbered source lines S2 and S4 in order to prevent the even-numbered source lines S2 and S4 from floating.

The relationship between the gate line driving signals to drive the third and fourth gate lines G3 and G4 and the precharge control signals PC1 and PC2 is similar to that between the above first and second gate line driving signals GD1 and GD2 and the precharge control signals PC1 and PC2.

FIG. 10 illustrates that both the first pulse PULL and the second pulse PUL2 are generated from the first precharge control signal PC1, but only either the first pulse PULL or the second pulse PUL2 may be generated from the first precharge control signal PC1. Also, FIG. 10 illustrates that both the third pulse PUL3 and the fourth pulse PUL4 are generated from the second precharge control signal PC2, but only either the third pulse PUL3 or the fourth pulse PUL4 may be generated from the second precharge control signal PC2.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Accordingly, the LCD device 200 according to an embodiment of the present general inventive concept may provide the utilities of the LCD device 100 illustrated in FIG. 4, and may prevent image degradation caused by a floating voltage or reduce power consumption when driving source lines.

In an LCD device and a method of driving the same according to various embodiments of the present general inventive concept, a level of a common voltage transits only once for each frame, thereby effectively reducing power consumption. A frequency of the common voltage can be reduced to be equal to that of a frame, thereby reducing audible noise. It is possible to drive two adjacent source lines by using one output buffer, thereby reducing the chip size of a source line driving unit. Also, it is possible to prevent image degradation caused by a floating voltage of a source line, and reduce power consumption when driving source lines.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An LCD (liquid crystal display) device, comprising:

a plurality of pixels each having a liquid crystal capacitor that includes a pixel electrode and a common electrode and being located at the intersections of a plurality of gate lines and a plurality of source lines;

a switch unit applying source line driving voltages having levels opposite to a common voltage applied to the common electrode, to the source lines; and a gate line driving unit sequentially outputting via the gate lines gate line driving signals to control the source line driving voltages to be applied to the pixel electrodes of the pixels, wherein the common voltage transits from a first level to a second level or vice versa at a boundary between a first half frame and a second half frame, the gate line driving signals are sequentially activated twice for each frame, and at the first half frame, the switch unit applies the source line driving voltages to only odd-numbered source lines, and at the second half frame, the switch unit applies the source line driving voltages to only even-numbered source lines.

2. The LCD device of claim 1, further comprising:

output buffers outputting the source line driving voltages to the switch unit, wherein a total number of output buffers is equal to half a total number of the source lines.

3. The LCD device of claim 1, wherein the gate line driving signals are sequentially activated at the first half frame and the second half frame.

4. The LCD device of claim 1, wherein the switch unit comprises:

a first set of switches applying the source line driving voltages to the odd-numbered source lines in response to an activated first switch control signal; and a second set of switches applying the source line driving voltages to the even-numbered source lines in response to an activated second switch control signal.

5. The LCD device of claim 4, wherein the first and second switch control signals are generated from the gate line driving signals.

6. The LCD device of claim 1, wherein at the first half frame, source line driving voltages having a positive electric potential with respect to the common voltage are applied to the odd-numbered source lines, and voltages of the even-numbered source lines are in a floating state, and at the second half frame, voltages of the odd-numbered source lines are in a floating state, and source line driving voltages having a negative electric potential with respect to the common voltage are applied to the even-numbered source lines.

7. The LCD device of claim 1, wherein at the first half frame, source line driving voltages having a negative electric potential with respect to the common voltage are applied to the odd-numbered source lines, and voltages of the even-numbered source lines are in a floating state, and at the second half frame, voltages of the odd-numbered source lines are in a floating state, and source line driving voltages having a positive electric potential with respect to the common voltage are applied to the even-numbered source lines.

8. An LCD (liquid crystal display) device, comprising:

a plurality of pixels each having a liquid crystal capacitor that includes a pixel electrode and a common electrode and being located at intersections of a plurality of gate lines and a plurality of source lines;

a switch unit applying source line driving voltages having levels opposite to a common voltage applied to the common electrode, to the source lines; and a gate line driving unit sequentially outputting via the gate lines gate line driving signals to control the source line driving voltages to be applied to the pixel electrodes of the pixels, wherein the common voltage transits from a first level to a second level or vice versa at a boundary between a first half frame and a second half frame, the gate line driving signals are sequentially activated twice for each frame, and at the first half frame, the switch unit applies the source line driving voltages to odd-numbered source lines, and then to even-numbered source lines, and at the second half frame, the switch unit applies the source line driving voltages to the even-numbered source lines, and then to the odd-numbered source lines.

9. The LCD device of claim 8, further comprising:

output buffers outputting the source line driving voltages to the switch unit, wherein a total number of output buffers is equal to half a total number of the source lines.

10. The LCD device of claim 8, wherein the gate line driving signals are sequentially activated at the first half frame and the second half frame.

11. The LCD device of claim 8, wherein the switch unit comprises:

a first set of switches applying the source line driving voltages to the odd-numbered source lines in response to an activated first switch control signal; and a second set of switches applying the source line driving voltages to the even-numbered source lines in response to an activated second switch control signal.

12. The LCD device of claim 11, wherein the first and second switch control signals are generated from the gate line driving signals.

13. The LCD device of claim 8, wherein at the first half frame, source line driving voltages having a positive electric potential with respect to the common voltage and a floating voltage are sequentially applied to the odd-numbered source lines, where the voltages applied to the even-numbered source lines are opposite to the voltages applied to the odd-numbered source line, and at a the second half frame, a floating voltage and source line driving voltages having a negative electric potential with respect to the common voltage are sequentially applied to the odd-numbered source lines, where the voltages applied to the even-numbered source lines are opposite to the voltages applied to the odd-numbered source lines.

14. The LCD device of claim 8, wherein at the first half frame, source line driving voltages having a negative electric potential with respect to the common voltage and a floating voltage are sequentially applied to the odd-numbered source lines, where the voltages applied to the even-numbered source lines are opposite to the voltages applied to the odd-numbered source line, and at a the second half frame, a floating voltage and source line driving voltages having a positive electric potential with respect to the common voltage are sequentially applied to the odd-numbered source lines, where the voltages applied to the even-numbered source lines are opposite to the voltages applied to the odd-numbered source lines.

15. An LCD (liquid crystal display) device, comprising:

a plurality of pixels each having a liquid crystal capacitor that includes a pixel electrode and a common electrode and being located at intersections of a plurality of gate lines and a plurality of source lines;

a switch unit applying source line driving voltages having levels opposite to a common voltage applied to the common electrode, to the source lines;

a gate line driving unit sequentially outputting via the gate lines gate line driving signals to control the source line driving voltages to be applied to the pixel electrodes of the pixels; and a precharge unit precharging the source lines to precharge voltages in order to prevent floating states of the source lines, before the source line driving voltages are applied to the source line, wherein the common voltage transits from a first level to a second level or vice versa at a boundary between a first half frame and a second half frame, the gate line driving signals are sequentially activated twice for each frame, and at the first half frame, the switch unit applies the source line driving voltages to only odd-numbered source lines, and at the second half frame, the switch unit applies the source line driving voltages to only even-numbered source lines.

16. The LCD device of claim 15, wherein before the source line driving voltages are applied to the source lines, the precharge unit precharges the source lines to the precharge voltages in order to increase a speed of driving the voltage of each of the source lines.

17. The LCD device of claim 16, wherein the precharge unit comprises:

precharge circuits applying the precharge voltages to the odd-numbered source lines in response to an activated first precharge control signal; and precharge circuits applying the precharge voltages to the even-numbered source lines in response to an activated second precharge control signal control signal.

18. The LCD device of claim 17, wherein the first and second precharge control signals are generated from the gate line driving signals.

19. The LCD device of claim 15, wherein at the first half frame, source line driving voltages having a positive electric potential with respect to the common voltage are applied to the odd-numbered source lines, and voltages of the even-numbered source lines are in a floating state, and at the second half frame, voltages of the odd-numbered source lines are in the floating state, and source line driving voltages having a negative electric potential with respect to the common voltage are applied to the even-numbered source lines.

20. The LCD device of claim 15, wherein at the first half frame, source line driving voltages having a negative electric potential with respect to the common voltage are applied to the odd-numbered source lines, and voltages of the even-numbered source lines are in a floating state, and at the second half frame, voltages of the odd-numbered source lines are in a floating state, and source line driving voltages having a positive electric potential with respect to the common voltage are applied to the even-numbered source lines.

21. An LCD (liquid crystal display) device, comprising:

a plurality of pixels each having a liquid crystal capacitor that includes a pixel electrode and a common electrode and being located at intersections of a plurality of gate lines and a plurality of source lines;

a switch unit applying source line driving voltages having levels opposite to a common voltage applied to the common electrode, to the source lines;

a precharge unit precharging the source lines to precharge voltages in order to prevent floating states of the source lines, before the source line driving voltages are applied to the source line; and a gate line driving unit sequentially outputting via the gate lines gate line driving signals to control the source line driving voltages to be applied to the pixel electrodes of the pixels, wherein the common voltage transits from a first level to a second level or vice versa at a boundary between a first half frame and a second half frame, the gate line driving signals are sequentially activated twice for each frame, and at the first half frame, the switch unit applies the source line driving voltages to odd-numbered source lines of the source lines and then to even-numbered source lines, and at the second half frame, the switch unit applies the source line driving voltages to the even-numbered source lines, and then to the odd-numbered source lines.

22. The LCD device of claim 21, wherein before the source line driving voltages are applied to the source lines, the precharge unit precharges the source lines to the precharge voltages in order to increase a speed of driving the voltage of each of the source lines.

23. The LCD device of claim 22, wherein the precharge unit comprises:

precharge circuits applying the precharge voltages to the odd-numbered source lines in response to an activated first precharge control signal; and precharge circuits applying the precharge voltages to the even-numbered source lines in response to an activated second precharge control signal control signal.

24. The LCD device of claim 23, wherein the first and second precharge control signals are generated from the gate line driving signals.

25. The LCD device of claim 21, wherein at the first half frame, source line driving voltages having a positive electric potential with respect to the common voltage and a floating voltage are sequentially applied to the odd-numbered source lines, where the voltages applied to the even-numbered source lines are opposite to the voltages applied to the odd-numbered source line, and at a the second half frame, a floating voltage and source line driving voltages having a negative electric potential with respect to the common voltage are sequentially applied to the odd-numbered source lines, where the voltages applied to the even-numbered source lines are opposite to the voltages applied to the odd-numbered source lines.

26. The LCD device of claim 21, wherein at the first half frame, source line driving voltages having a negative electric potential with respect to the common voltage and a floating voltage are sequentially applied to the odd-numbered source lines, where the voltages applied to the even-numbered source lines are opposite to the voltages applied to the odd-numbered source line, and at a the second half frame, a floating voltage and source line driving voltages having a positive electric potential with respect to the common voltage are sequentially applied to the odd-numbered source lines, where the voltages applied to the even-numbered source lines are opposite to the voltages applied to the odd-numbered source lines.

27. A method of driving an LCD (liquid crystal display) device having a plurality of pixels each including a liquid crystal capacitor that includes a pixel electrode and a common electrode and being located at intersections of a plurality of gate lines and a plurality of source lines, the method comprising:

allowing a common voltage, which is applied to the common electrode, to transit from a first level to a second level or vice versa at a boundary between a first half frame and a second half frame, the gate line driving signals are sequentially activated twice for each frame;

at the first half frame, applying source line driving voltages having levels opposite to the common voltage to only odd-numbered source lines;

at the second half frame, applying the source line driving voltages to only even-numbered source lines; and sequentially activating gate line driving signals at the first and second half frames, where the gate line driving signals control the source line driving voltages applied to the source lines to be applied to the pixel electrodes of the pixels.

28. The method of claim 27, before applying the source line driving voltages to the source lines, further comprising:

precharging the source lines to precharge voltages so as to prevent floating states of the source lines.

29. The method of claim 27, before applying the source line driving voltages to the source lines, further comprising:

precharging the source lines to precharge voltages so as to increase a speed of driving one of voltages of the source lines.

30. A method of driving an LCD (liquid crystal display) device having a plurality of pixels each including a liquid crystal capacitor that includes a pixel electrode and a common electrode and being located at intersections of a plurality of gate lines and a plurality of source lines, the method comprising:

allowing a common voltage, which is applied to the common electrode, to transit from a first level to a second level or vice versa at a boundary between a first half frame and a second half frame, the gate line driving signals are sequentially activated twice for each frame;

at the first half frame, applying source line driving voltages having levels opposite to the common voltage to odd-numbered source lines and then to even-numbered source lines;

at the second half frame, applying the source line driving voltages to the even-numbered source lines and then to the odd-numbered source lines; and sequentially activating gate line driving signals at the first and second half frames, where the gate line driving signals control the source line driving voltages to be applied to the pixel electrodes of the pixels.

31. The method of claim 30, before applying the source line driving voltages to the source lines, further comprising:

precharging the source lines to precharge voltages so as to prevent floating states of the source lines.

32. The method of claim 30, before applying the source line driving voltages to the source lines, further comprising:

precharging the source lines to precharge voltages so as to increase a speed of driving one of voltages of the source lines.

33. An LCD (liquid crystal display) device, comprising:

a plurality of gate lines, a plurality of source lines and a plurality of pixels disposed at an intersection of the gate lines and source lines, respectively, the qate lines receiving qate line driving signals that are sequentially activated twice during each of a first half frame and a second half frame; and a switch unit to apply source line driving voltages to one of odd-numbered source lines and even numbered source lines at a first portion of a frame, and to apply the source line driving voltages to an other of the odd-numbered source lines and the even numbered source lines at a second portion of the frame.

34. The LCD of claim 33, wherein each of the pixels comprise:

a liquid crystal capacitor having a pixel electrode and a common electrode, wherein a common voltage is applied to the respective common electrodes.

35. The LCD of claim 33, further comprising:

a precharge unit to precharge the source lines to precharge voltages prior to the source line driving voltages being applied to the source lines to prevent floating states of the source lines.

36. A computer-readable recording medium having embodied thereon a computer program to execute a method, wherein the method comprises:

allowing a common voltage applied to the common electrode to transit between a first level and a second level at a boundary between a first half frame and a second half frame;

applying source line driving voltages having levels opposite to the common voltage to odd-numbered source lines at the first half frame, the gate line driving signals are sequentially activated twice for each frame;

applying the source line driving voltages to even-numbered source lines at the second half frame; and sequentially activating gate line driving signals at the first and second half frames, wherein the gate line driving signals control the source line driving voltages applied to the source lines to be applied to pixel electrodes of the pixels.

* * * * *